United States Patent [19]

Politzer et al.

[11] 4,022,104

[45] May 10, 1977

[54] BREECHBLOCK SEALING FOR LARGE-CALIBER BARRELED WEAPONS

[75] Inventors: Anton Politzer, Lauf; Wilhelm Machmer, Nurnberg, both of Germany

[73] Assignee: DIEHL, Nurnberg, Germany

[22] Filed: July 23, 1975

[21] Appl. No.: 600,910

[30] Foreign Application Priority Data

July 24, 1974 Germany ..... 2435520

[52] U.S. Cl. ..... 89/26

[51] Int. Cl.[2] ..... F41F 11/02

[58] Field of Search ..... 42/25, 16; 89/26, 17, 89/19

[56] References Cited

UNITED STATES PATENTS

| | | | |
|---|---|---|---|
| 159,170 | 1/1875 | Felt | 89/26 |
| 162,807 | 5/1875 | Davison | 89/26 |
| 270,299 | 1/1883 | Freyre | 89/26 |
| 819,186 | 5/1906 | Vollmer | 89/26 |
| 1,376,130 | 4/1921 | Asbury | 89/26 |
| 2,980,100 | 8/1949 | Weiss et al. | 89/26 X |
| 3,114,290 | 12/1963 | Harvey et al. | 89/26 |
| 3,403,596 | 10/1968 | Bartels | 89/26 |
| 3,738,223 | 6/1973 | Post | 89/26 |

*Primary Examiner*—Harold Tudor

[57] ABSTRACT

A ring closure arrangement for the breechblocks of large-caliber barreled weapons; including a closure seal ring having an angled profile in a longitudinal axial section thereof, with the seal ring being prestressed at a closed breechblock position for sealing the end of the barrel against the breechblock. A recess is formed in the breechblock, the seal ring being axially displaceable within the recess; and actuating means being located in the breechblock for imparting axial movement to and pressing the seal ring against the end of the barrel.

5 Claims, 1 Drawing Figure

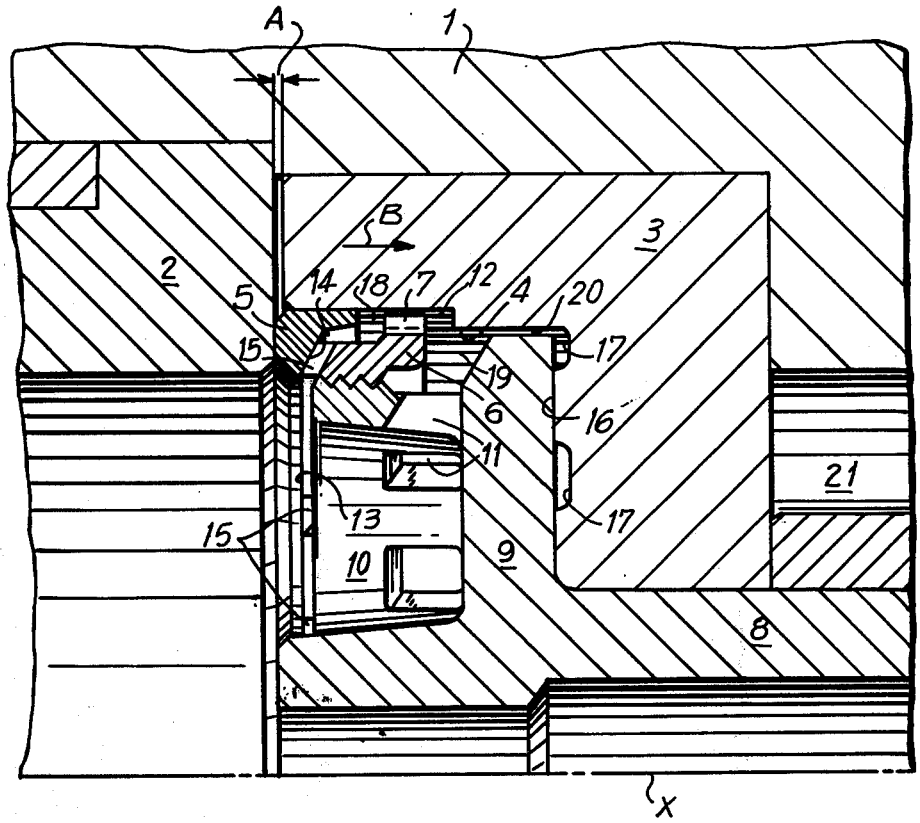
A
1
B
2
3
5
14
18
7
12
4
20
15
17
19
6
16
11
21
13
17
15
10
9
8
X

BREECHBLOCK SEALING FOR LARGE-CALIBER BARRELED WEAPONS

FIELD OF THE INVENTION

The present invention relates to a breechblock seal for large-caliber barreled weapons.

DISCUSSION OF THE PRIOR ART

In barrelled weapons which are utilized for caseless ammunition and incorporating a classical closure or breechblock, it is known to support an obturator or closure seal ring having an angular profile in the gun barrel, (U.S. Pat. No. 3,403,596; Waffentechnisches Taschenbuch, Rheinmetall GmbH, Dusseldorf, 2nd Edition, Page 309). Hereby, it is disadvantageous that at even the most accurate manufacture, a basic play or tolerance must be present between the cartridge chamber with regard to the closure seal ring and breechblock. This basic tolerance does not evince itself only due to reasons of manufacture but also through the temperature stresses which come into question in connection with the particular components. Due to the mass moment of inertia of the closure seal ring at a buildup of pressure, the gap which is required in view of the basic tolerance cannot be closed rapidly enough. As a result, gas back drifting and erosion will be encounterd at the sealing surfaces. A mechanical control of an obturator or closure seal ring which is supported within the gun barrel is extremely difficult, in particular, at high gas pressures.

SUMMARY OF THE INVENTION

Accordingly, it is an object of the present invention to provide a sealing arrangement which, at already the initiation of the development of shot recoil, is positioned against the barrel under prestressing.

By means of the construction of the present invention, as set forth hereinbelow, there is achieved that gas leakages which are occasioned through manufacturing tolerances, temperature variations and, can be readily avoided. Moreover, the sealing system or arrangement which is located in the breechblock, affords the advantage of an easy accessibility for purposes of maintenance.

In a further advantageous aspect of the invention there is attained an axial guidance of the closure seal ring in a direction towards the end of the barrel.

Moreover, the present invention also provides an extremely compact arrangement for the breechblock sealing system.

According to another object of the present invention, there is attained, on the one hand, a low degree of surface pressure of the closure seal ring and, on the other hand, a cardan or universal type of support thereof. That type of support facilitates the closure seal ring to compensate for deviations of the barrel-ended sealing surfaces from a plan-parallel relationship.

In accordance with a further aspect of the invention, the latter provides for the closure seal ring being subject to the entire gas pressure during the development of shot recoil.

A particularly effective degree sealing of the base portion of the sealing system or arrangement by means of the breechblock closure is achieved by the construction of the present invention.

BRIEF DESCRIPTION OF THE DRAWING

Reference may now be had to the following detailed description of an exemplary embodiment of the invention, taken in conjunction with the single FIGURE of the accompanying drawing, in which the latter shows a sectional view taken through an obturating or breechblock closure arrangement for large caliber barreled weapons.

DETAILED DESCRIPTION

A ring closure seal, shown in cross-section, lying in the bore axis X of the weapon seals a tube or barrel 2 which is located in the base portion 1 of a weapon with regard to a transversely movable wedge-type breechblock 3. The wedge-type breechblock is illustrated in the firing position, and evidences a space A with respect to the end of the barrel.

The ring closure seal is positioned in a recess 4 in the wedge-type breechblock 3. It consists of an obturator or seal ring 5 having an angled profile in transverse section, an intermediate ring or spacer 6 with a plurality of projections 7 arranged about the circumference thereof, and a rotary member 8 which is rotatably supported within the wedge-type breechblock 3.

The rotary member 8 possesses a central recess for receiving a firing arrangement (not shown). Moreover, it includes a flange 9 having a collar-shaped threaded shaft 10. This threaded shaft 10 possesses a plurality of gas through-flow passages 11. For effectuating the drive of the rotary member 8, a gear wheel may be provided at the free end thereof.

The spacer or intermediate ring 6 engages with its projections 7 into elongate grooves 12 formed in the recess 4.

The ring-shaped contact surfaces 13, 14 of the spacer or intermediate ring 6 and the seal ring 5 are conically shaped, so that the contact surface 13 of the intermediate ring 6 is interrupted by the gas passages 15 which are provided along the circumference thereof.

A base-ended sealing between the flange 9 and the base or bottom surface 16 of the recess 4 of the wedge-like breechblock 3 is effectuated by means of annular grooves 17 which are formed in the bottom surface 16.

For the opening of the wedge breechblock 3, the rotary member 8 is rotated in an opening direction by means of a suitable drive (not shown) so that, through intermediary of the relatively flat-like threads between the rotary member 8 and the spacer or intermediate ring 6, the latter is raised away from the seal ring 5 in the direction of arrow B. Thereby, the wedge breechblock 3 may be removed by means of the drive from the base portion 1 of the weapon, and a shell may be introduced into the barrel 2 through the loading aperture 21.

After the closure of the wedge-like breechblock 3 there is effected the prestressing of the closure seal ring through rotation of the rotary member 8 into a closed position whereby the rotary member 8 is supported through intermediary of its flange 9 against the bottom surface 16 of the wedge-like breechblock 3 and thereby, by means of its threaded portion and through the spacer or intermediate ring 6, presses the closure seal ring 5 against the barrel 2.

The gas pressure of the ignited shell, respectively, caseless charge, which becomes fully effective in the hollow space 18, through the gas flow passages 15, additionally aids in pressing the seal ring 5 against the barrel 2 and against the wedge-like breechblock 3. By means of the gas passages 11, 15 in the intermediate ring 6 and the rotary member 8, the intermediate spacer ring 6 is subjected to a pressure compensation. Contrastingly, the previously similarly prestressed flange is pressed against the bottom surface 16 of the breechblock 3 through action of the gas pressure which is effective in the hollow space 19. The annular grooves 17, on the one hand, cause an increase in the specific surface pressure between the flange 9 and the bottom surface 16 and, on the other hand, through an annular gap 20 formed between the flange 9 and the recess 4 and through the annular grooves 17, the lateral gas pressure is reduced during the development of shot recoil.

The application of the described ring closure may also be utilized in connection with screw-or pivot closures, wherein the sealing surfaces between the barrel and the closure seal ring may be planar, as well as spherical or, respectively, conical.

While there has been shown what is considered to be the preferred embodiment of the invention, it will be obvious that modifications may be made which come within the scope of the disclosure of the specification.

What is claimed is:

1. In a ring closure arrangement for the breechblocks of large-caliber barreled weapons; including a closure seal ring having an L-shaped cross-section in a longitudinal axial section thereof, said seal ring being prestressed at a closed breechblock position for sealing the end of the barrel against said breechblock, the improvement comprising: a recess formed in said breechblock, said seal ring being axially displaceable within said recess; actuating means in said breechblock for imparting axial movement to and pressing said seal ring against the end of said barrel guide grooves in said recess; an intermediate spacer ring having projections slidable along said guide grooves in said recess of said breechblock and adapted to contact said seal ring responsive to operation of said actuating means; said intermediate spacer ring comprising a threaded nut; a rotary member having a collar-shaped drive shaft for actuating said intermediate spacer ring; said rotary member having a flange contacting a bottom supporting surface on said breechblock.

2. A ring closure arrangement as claimed in claim 1 wherein the contacting surfaces between said seal ring and said intermediate spacer ring of substantially conical, said intermediate spacer ring being separated from said seal ring and rotary member by annular hollow spaces, said hollow spaces being in combination with the barrel through gas passage apertures formed in said intermediate spacer ring and in said rotary member, said breechblock having annular grooves in the bottom surface of said recess for sealing of the rotary body flange, said breechblock having a small radially extending annular gap form between said flange and said recess.

3. A ring closure arrangement as claimed in claim 1, the contacting surfaces between said seal ring and said intermediate spacer ring being essentially conical.

4. A ring closure arrangement as claimed in claim 1 wherein said intermediate spacer ring is separated from said seal ring and rotary member by annular hollow spaces, said hollow spaces being in communication with the barrel through gas passage apertures formed in said intermediate spacer ring and in said rotary member.

5. A ring closure arrangement as claimed in claim 1, said breechblock including annular grooves in the bottom surface of said recess for sealing of the rotary body flange; and a small radially extending annular gap being formed between said flange and said recess.

* * * * *